US005619891A

United States Patent [19]

Tiede

[11] Patent Number: 5,619,891

[45] Date of Patent: Apr. 15, 1997

[54] RATCHETING SCREWDRIVER

[75] Inventor: Clair L. Tiede, Mukwonago, Wis.

[73] Assignee: Beere Precision Medical Instruments, Inc., Racine, Wis.

[21] Appl. No.: 553,866

[22] Filed: Nov. 6, 1995

[51] Int. Cl.[6] ..... B25B 13/46

[52] U.S. Cl. ..... 81/62; 192/43.1

[58] Field of Search ..... 81/60, 62; 192/43.1

[56] References Cited

U.S. PATENT DOCUMENTS

| | | | |
|---|---|---|---|
| 277,561 | 5/1883 | Furbish . | |
| 791,895 | 6/1905 | Furbish . | |
| 2,564,356 | 8/1951 | Dianda . | |
| 2,627,330 | 2/1953 | Gantz | 192/43.1 |
| 3,742,487 | 6/1973 | Whiteford . | |
| 4,290,328 | 9/1981 | Clark . | |
| 4,466,523 | 8/1984 | DeCarolis et al. . | |
| 4,777,852 | 10/1988 | Herman et al. . | |

*Primary Examiner*—James G. Smith
*Attorney, Agent, or Firm*—Arthur J. Hansmann

[57] ABSTRACT

A ratcheting screwdriver with a handle and a gear rotatable therein and two pawls engageable between the handle and the gear, for selective ratcheting action. A ring is rotatable on the handle for removing the pawls from engagement with the gear, and springs yieldingly bias the pawls into engagement with the gear. The ring has recesses on a circular wall for receiving portions of the pawls in pivoting the pawls into engagement with the gears.

25 Claims, 2 Drawing Sheets

RATCHETING SCREWDRIVER

This invention relates to a ratcheting screwdriver, and, more particularly, it relates to a screwdriver which can ratchet in either the clockwise or counter-clockwise direction or it can be placed in a non-ratcheting mode from both the clockwise and counter-clockwise rotation.

Ratcheting screwdrivers of the aforementioned type are already known in the art. One example of such screwdriver is shown in U.S. Pat. No. 4,777,852. However, in this patent, a somewhat complicated lever system is utilized for selectively actuating two spaced-apart pawls for their alternate engagement with a gear, all to produce the desired ratcheting action in either direction. In that arrangement, the two pawls are spaced apart and are movable tangentially of a driven gear which they engage, but the pawls are arranged to be slidable tangentially and into and out of gear engagement.

The present invention differs from the aforementioned example in that the present invention has two pawls which are pivotally mounted on the screwdriver handle and which pivot about a fixed axis and into and out of engagement with the driven gear. In that regard, U.S. Pat. Nos. 277,561 and 791,895 and 2,564,356 and 3,742,787 and 4,290,328 and 4,466,523 show some pivotally mounted pawls, but mainly they are not pivotal about a fixed pivot axis, and/or they do not have an actuator or control ring which surrounds the handle and which is positionable in either the clockwise or counter-clockwise ratcheting rotation and that positioning being identical to the direction of actual ratcheting. In this regard, the actuator ring is in direct physical contact with the pawls for alternately positioning the pawls either into gear engagement or disengagement.

Accordingly, the present invention improves upon the prior art by providing a ratcheting screwdriver which is symmetrical about a longitudinal axis and therefore has an actuator ring located about said axis and with the pawls being on fixed pivotal axes for swinging movement into and out of engagement with a driven gear. The arrangement is such that there is a minimal amount of lost motion between the driving pawls and the driven gear when either pawl is in gear engagement. This therefore provides for an accurate and sturdy arrangement of the ratcheting screwdriver through the gear arrangement mentioned.

DETAILED DESCRIPTION OF THE PREFERRED EMBODIMENTS

Figure 2:
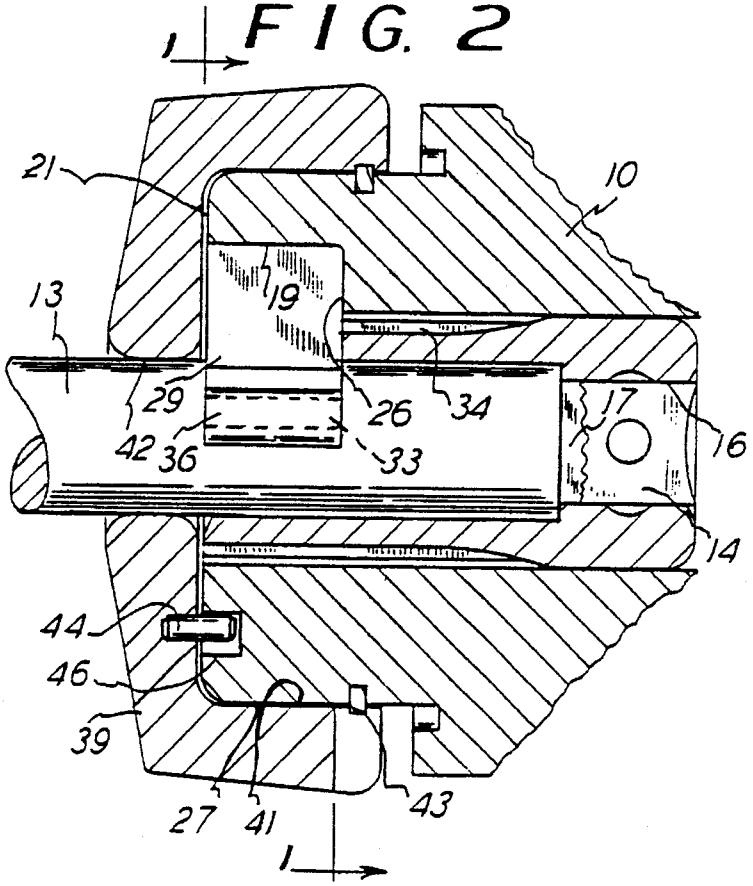
FIG. 2 is a sectional view taken substantially along the plane designated 2—2 of FIG. 1, and with the plane offset to the right to show the spring and the pawl, and with a fragment of a screwdriver bit added thereto.
Figure 1:
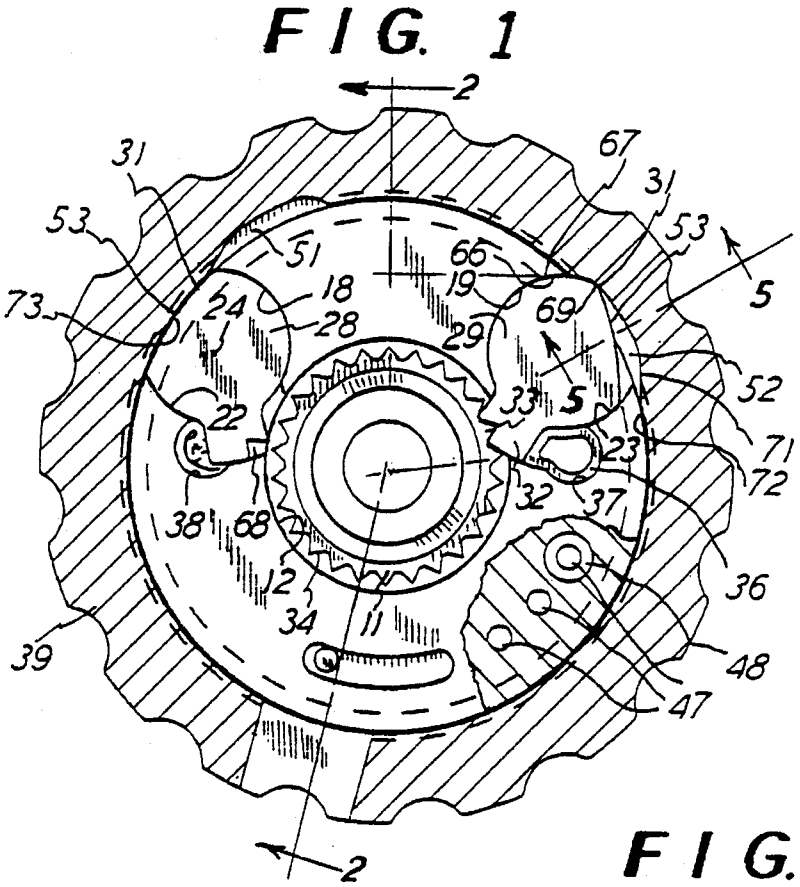
FIG. 1 is a sectional view of a ratcheting screwdriver of this invention, and with the view being taken along the plane 1—1 of FIG. 2.
Figure 5:
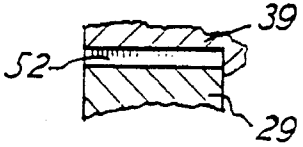
FIG. 5 is a sectional view of a fragment of the screwdriver of FIG. 1, and taken along the plane 5—5 of FIG. 1.

FIGS. 1 and 2 show one embodiment of the invention, and it will here be noted that the two embodiments shown in all of the figures differ from each other with regard to the resilient or spring means which actuates the pawls, all as hereinafter described.

Accordingly, the two embodiments include a screwdriver handle, as shown by the handle fragment 10, and a cylindrically-shaped gear 11 is rotatably mounted in a circular bore 12 in the handle 10. Only FIG., 2 shows a screwdriver bit 13, in fragmentation, and that bit is telescoped within the cylindrical gear piece 11, and there is a square end 14 mated between the gear piece bore 16 and the screwdriver bit square end 17. Thus, the rotation of the gear 11 causes identical rotation of the screwdriver bit 13, and of course that rotation can be in either direction.

The handle 10 has two circularly-shaped pockets 18 and 19 countersunk therein off the handle end wall 21. The pockets 18 and 19 are circular, and at least arcuate, and include the circularly-shaped walls 22 and 23 such that the arcuate configurations 18 and 22, for example, are centered about an axis designated 24, and that is a fixed pivot axis. Also, the arcs 18 and 22 and the arcs 19 and 23 are located in diametrically opposed positions to thereby fully support and confine the pawls shown therein. Therefore, each of the pockets 18 and 19, in their circular shaping, have a fixed pivot axis at the center of the circles, such as the axis 24.

The aforementioned bores are arranged to terminate in an end wall 26, as shown in FIG. 2. Also, the end of the handle 10 has a cylindrical wall defined by the circle designated 27. As seen in FIG., 1, the circle 27 intersects the respective arcuate walls or pockets, as designated 18, 19, 22, and 23.

Disposed within the substantially circular pockets, are two pawls 28 and 29, as seen in FIG. 1. The pawls 28 and 29 include the substantially circular body portion 31 and the extended portion 32 which has gear teeth 33 thereon.

As such, the substantially circularly-shaped pawls 28 and 29 are disposed in snug contact in the respective pockets which will be designated 18 and 19, and the pawls are in sliding contact with the pocket surfaces 18, 19, 22 and 23 to be in accurate and relatively stable positions with respect to the handle 10. That is, there is virtually no play or lost motion between the pawls 28 and 29 and the handle 10, even though the pawls 28 and 29 are pivotal about their respective axes 24.

The gear piece 11 has gear teeth 34 distributed therearound, and the teeth 34 are in position for engagement with the pawl teeth 33, such as shown with the pawl 29 in FIG. 1. It will be seen and understood that counter-clockwise rotation of the handle 10 will impart a counter-clockwise rotation to the screw-driver bit 13 by virtue of the pawl 29 being in the FIG. 1 engaged position. Thus, the pawls engage the gear circularly disposed teeth 34 in substantially a tangential arrangement, and the line of force from the pawls is from the surface 19, at least adjacent the handle circular wall 27, and through the axis 24 of the pawl and onto the gear teeth 34 through the pawl teeth 33. In that manner, there is optimum transfer of rotational torque from the handle to the bit 13, and virtually no lost motion or lost effort because of the geometry described, To position the pawl 29 into the engaged position shown in FIG. 1, there is a resilient member, or spring, designated 36, and it is actually in the form of a flexible tubular piece, and particularly it is a silicone rubber type of tube which is flexible, therefore yieldable under force,but where it is tubular in original unassembled condition, but it will assume the shape shown in assembly, the silicone rubber is capable of repeated flexing and regaining, all while applying the desired force against the pawl, such as shown in FIG. 1 with regard to the pawl 29. Therefore, the handle 10 has additional pockets 37 and 38 which are adjacent the pawl pockets described, and these pockets 37 and 38 receive the respective silicone rubber type springs 36. That is, with no other force on the pawl 29, the silicone rubber spring 36 will urge the pawl 29 in the clockwise direction to where the pawl teeth 33 engage the gear teeth 34, as shown in FIG. 1. Therefore, the pawl pockets and the silicone rubber spring pockets 37 and 38 are open to each other such that the silicone rubber and tubular type springs-36 can project into the pawl pockets for the actuation of the pawls, as shown in FIG. 1 with the pawl 29.

A ratcheting actuator, in the form of a ring designated 39, is rotatably mounted on the housing circular wall 27. The ring 39 has an inner circular wall 41 which is slidably and snugly related to the housing circular wall 27 so that the ring 39 is piloted on the housing 10. Also, the ring 39 has a central opening 42 through which the screwdriver 13 can extend, and of course the ring 39 completely surrounds the screwdriver, so that all is symmetrical about the longitudinal axis of the screwdriver bit 13. A circular snap ring 43 inter-engages the housing 10 and the ring 39 to secure the two together, but yet permit the rotation of the ring 39, as mentioned, The ring 39 has a pin 44 extending therefrom and into an arcuate slot 46 in the housing face 21. With that arrangement, the ring 39 is restricted in its rotational motion back and forth on the housing surface 27, and of course the restriction is determined by the length of the arcuate groove 46 which receives the pin 44. Also, a standard type of ball and hole arrangement is utilized for holding the rotation of the ring 39 in one of three selected positions relative to the handle 10, and that is shown by the three hole circles 47, and it will be understood that there is a ball or plunger on the item 48 which is spring-loaded into the selective holes 47, and is also releasable therefrom, when the ring 39 is rotated and also when it is released from rotation. The arrangement of the limitation of the rotation of the ring 39 and the establishment of the three set positions just described are conventional and will be readily understood, and that my be as shown in the aforementioned patents, including U.S. Pat. No. 4,777,852 in that old and well-known arrangement of indexing one rotation member on another.

As shown, the two pawls 28 and 29 are disposed on completely and only the upper half of the screwdriver, as viewed in FIG. 1, for instance, that is, rather than on diametrically opposite sides of the screwdriver. This therefore permits the minimal lost motion and optimal tangential force between the pawls and the gear 11.

The ring surface 41 has two recesses 51 and 52 which are of short arcuate extent along the ring wall 41 and which are spaced apart a distance less than the spacing of the pawls 28 and 29 along the walls 27 and 41, as shown in FIG., 1. Therefore, with the ring 39 in the rotated position shown in FIG. 1, the portion 31 of the pawl 29 is disposed within the pocket 52, under the influence of the spring 3, and thus the pawl 29 is in engagement with the ring teeth 34. At the same time, the pawl 28 is not in engagement with the gear teeth 34, and this is so because the recess 51 is away from the pawl 28 and thus the ring surface 41 is engaging the pawl outer arcuate surface 53 to thereby urge the pawl 28 into the disengaged position shown and to be urging it against the spring urging of the silicone spring 36.

Accordingly, the ring 39 has the two recesses 51 and 52 which alternately receive the respective portions 31 of the pawls 28 and 29, for alternate engagement with the gear teeth 34, and also the pawls 28 and 29 have their surfaces 53 in engagement with the ring wall 41 in the certain rotated position of the ring 39 to thereby have the pawl, such as the pawl 28 disengaged with respect to the gear teeth 34.

In that arrangement, it will be seen and understood that when the ring 39 is rotated counter-clockwise, as it is in the position of FIG. 1 and considering it from the right end of FIG. 2, then counter-clockwise rotation of the handle 10 will generate corresponding counter-clockwise rotation of the screwdriver bit 13, as desired, because the counter-clockwise rotation of the ring 39 dictated the drive direction for the bit 13, as desired. Of course the opposite directions of rotation would also be true if the ring 39 were rotated in the clockwise direction so that the pawl 28 would then be in engagement with the gear teeth 34 because the ring recess 51 would have received the pawl end 31 and cause the pawl to pivot about its fixed axis 24 into the gear-engaged position. At the same time, the pawl 29 would have been moved out of engagement with the teeth 34 because the ring wall 27 would have slid over the pawl arcuate portion 53 to cause the pawl to pivot out of the gear-engaged position.

Figure 4:
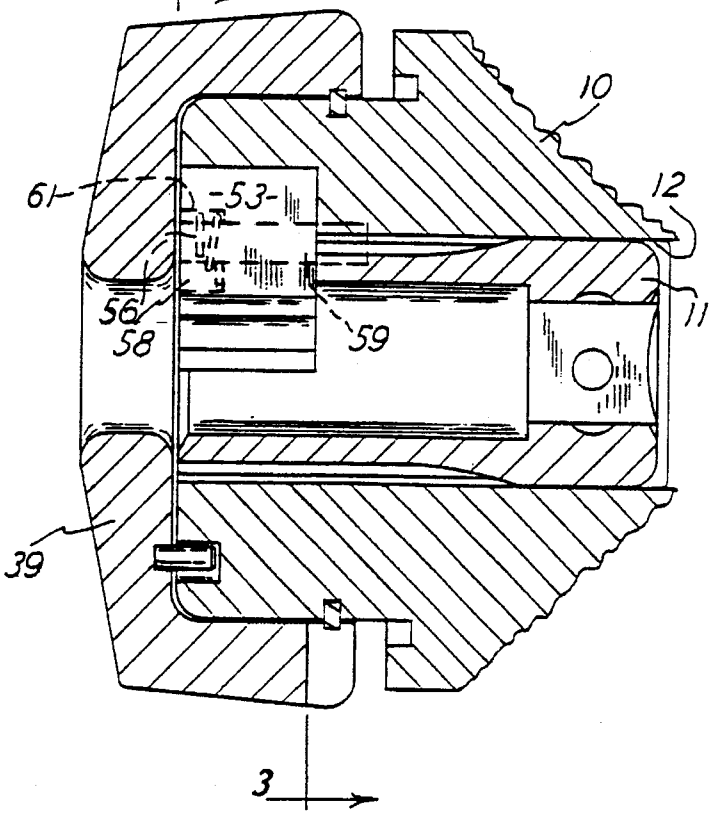
FIG. 4 is a sectional view taken substantially along the plane 4—4 of FIG. 3.
Figure 3:
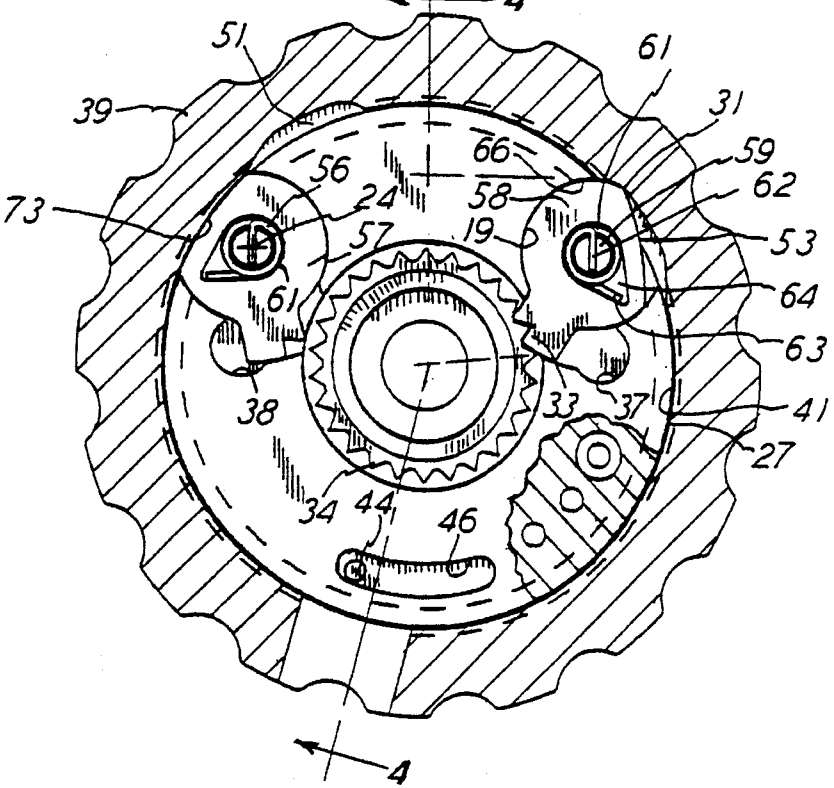
FIG. 3 is a sectional view of another embodiment of this ratcheting screwdriver, and with the view being taken along the plane 3—3 of FIG. 4 and with the plane offset to the right to show the pocket and the pawl.

As mentioned, the embodiment of FIGS. 3 and 4 is different from the embodiment of FIGS. 1 and 2 with regard to the spring, and in FIGS. 3 and 4, a torsion spring 56 is applied to the pawls 57 and 58, in that embodiment, thus, there is a pin 59 fixed in the housing 10 to project into the pawl pockets and to provide a fixed pivot for the adjacent pawls 57 and 58 which have a recessed pocket 61 for receiving the torsion spring 56, as shown in FIG. 3 and 4. Thus, each of the springs 56 have one of their ends 62 fixed in the pin 59, and the other torsion spring end 63 is fixed in a pocket 64 in the respective pawl 57 and 58, as shown in FIG. 3. Also the pockets 37 and 38 are clearly seen in FIG. 3, and they provide the room for pivot of the pawl portions 32.

In both embodiments, there is a fixed pivot for the respective pawls, and the line of force from the handle to the pawls and to the gear 34 is through that fixed pivot and tangentially to the gear 34. Also, the pawls are guided and supported through the snug and slidable circular type of mating relationship with the bores 19 of the handle 10.

In detail, the bore 19 presents a circular wall 66 which is about one-third of a complete circle, and the pawl 29 has a corresponding partial circular exterior wall 67 in sliding contact with the concave wall 66. Thus, the counter-clockwise rotation of the handle 10 causes the wall 66 to bear against the surface 67 and urge the pawl 29 in the clockwise direction, as seen in FIG. 1. Because the spring 36 is holding the pawl teeth 33 in engagement with the gear teeth 34, the pawl 29 transmits the rotational torque to the gear 11. That is, the teeth 33 and 34 are engaged in a manner such that the spring 36 can hold them in engagement in that direction of rotation described as clockwise as viewed in FIG. 1. Of course, in counterclockwise direction of rotation as viewed in FIG. 1, the pawl teeth 33 would simply ride over the gear teeth 34 in the ratcheting action. The teeth 33 and 34 are respectively angulated to achieve the aforementioned, that is, to be in torque-transmitting relationship in one direction of rotation and to be in ratcheting or non-driving engagement in the other direction. Thus there is substantially ninety degrees between the two adjacent faces of the teeth 34, and there is a lesser angle of approximately seventy degrees at the opening designated 68 and thus between the faces of the adjacent tooth surfaces for the pawl teeth 33.

Also, the pawl surface 53 is arcuate, to conform to the circle of the handle cylindrical wall 27, and each end of the arc 53 forms an obtuse angle with the pawl circular portions adjacent thereto, such as the pawl portion 67, and that would be the one corner 69. As shown, there is a surface 53 defining a corner 69 on all pawls as seen at the upper ends of the pawls in FIGS. 1 and 3. Also, the ring recess 52 has a ramp portion 71 which engages the pawl corner 69 when the ring 39 is rotated counter-clockwise, as viewed in FIG. 1, and the pawl 29 is cammed into released position against the pressure of the spring 36. Of course the ring 39 would continue to rotate until it achieves the mirror image position as shown with regard to the pawl 28 and its recess 51 if the ratcheting is to be in the direction opposite to that shown in the engagement position shown in FIG. 1.

The embodiment of FIGS. 3 and 4 is similar to the aforementioned in function, and the pin 59 only loosely supports the pawl 58 so that the torque-engaging surfaces described in connection with FIGS. 1 and 2 are effective in the embodiment shown in FIGS. 3 and 4. That is, the pin 59 does not preclude the contact between the arcuate handle wall 66 and the arcuate pawl surface 67.

It will be noticed that the spacing between the recesses 51 and 52 such as on the upper half of FIG. 1, is less than the spacing between the pawls 28 and 29 along the arcuate wall 27. Thus, the pawls are only alternately actuated, but the pawls can still be simultaneously in engagement with the gear 34 when the ring 39 is rotated to the central position of the three positions designated 47. That is, the recesses 51 and 52 would both be receiving the pawl corners 69 at the time that the pawl teeth 33 are engaged with the gear teeth 34. That is, the showing is such that when the ring 39 is rotated counterclockwise, as views in FIG. 1, the corner 69 of the pawl 29 is still in pocket 52 and is adjacent ramp portion 71 and thus pawl 29 is still engaged with gear teeth 34. Simultaneously, pocket 51 was rotated to a position to receive the upper corner 69 of pawl 28 to cause pawl 28 to pivot into engagement with gear teeth 34.

The elements 47 and 48 constitute a positioner for establishing the temporary rotated position of the ring 39. Also, the pawls, along with the recesses are all on only one-half of the circle, such as viewed in FIG. 1. Further, the pawl teeth 33 engage the gear teeth 34 at a location offset from a line from the longitudinal axis of the gear 11 and through the pivot axis 24 of the pawls. Thus, there is drive from the pawls, in one direction of rotation, and there is ratcheting in the other direction of rotation. Of course the ring 39 can also be positioned so that both pawls 28 and 29, for instance, can be in gear tooth-engaged position, and that would be when the respective recesses 51 and 52 are receiving the pawl corners 69, as mentioned. Also, the ring wall 41 has two short arcuate lengths 72 and 73 which alternately engage the pawl arcuate walls 53,such as shown with the pawl 28, for positioning the pawls in the alternate disengaged position, and never simultaneously disengaged even though they can be simultaneously engaged with the gear teeth 34. The surfaces 72 and 73 are contiguous to the recesses 52 and 51, respectively and are of course spaced further apart than the spacing of the recesses 51 and 52 along the circular wall 27. Also, the space in between the recesses 51 and 52 is less than the maximum positioning or spacing, of the pawls 28 and 29 along the arcuate wall 27, all as shown. It will be further seen in FIGS. 1 and 3 that the pockets 51 and 52 have portions thereof spaced apart along circular wall 27 a distance which is the same as the spacing therealong of corners 69 so that the corners 69 will be simultaneously received in the respective pockets 51 and 52 upon central rotation position of the ring 39.

The stop pin 44 and its groove 46 can actually be omitted because the pawls themselves serve as stops for the ring 39, such as shown with, the pawl 2 stopping the ring 39 in the clockwise direction of rotation, as viewed in FIG. 1. Of course the pawl 28 would serve as a stop for the ring 39 in the counter-clockwise rotation of ring 39 as viewed in FIG. 1. This means that the pawl teeth 32 are fully engaged with the gear teeth 33 at the time that the ring 39 is rotated to either extreme position and at that time, in the FIG. 1 condition, the wall of the ring 39 defining the upper end of the recess 52 abuts the corner 31 of the pawl 29 all as shown in FIG. 1. Therefore, the locations and dimensions of the recesses 51 and 52 are arranged for the abutting or stoping action of the ring 39 on the respective pawls 28 and 29.

What is claimed is:

1. A ratcheting screwdriver comprising a handle having a cavity defined by two arcuate walls, a gear rotatably supported on said handle and having teeth facing said arcuate walls and said gear being arranged to receive a screwdriver bit, two pawls with teeth and with each of said pawls being respectively pivotally supported on one of said arcuate walls for pivoting in a plane toward and away from said gear and extending into toothed driving engagement with said gear teeth in one direction of handle rotation and said pawls being in ratcheting relationship with said gear in a direction of handle rotation which is opposite to said one direction, a resilient member operative on said pawls for urging said pawls into tooth engagement with said gear teeth in the rotation drive from said handle to said gear, a ring rotatably supported on said handle and in said pivot plane of said pawls and having a circular wall surrounding said handle, said ring circular wall having two recesses therein adjacent said two pawls, said pawls having portions respectively received in said recesses when said pawls are in tooth engagement with said gear, and said pawls and said ring circular wall having mutually engageable surfaces arranged whereby rotation of said ring alternately pivots said pawls out of engagement with said gear teeth and for ratcheting action on said gear upon rotating said handle relative to said gear.

2. The ratcheting screwdriver as claimed in claim 1, wherein one of said pawls is pivotable to a position to transmit rotation to said gear in one direction, and said recesses and said pawls are positioned and arranged such that rotation of said ring in said one direction positions said recesses away from said one of said pawls, and said ring circular wall having a portion thereof for holding said one of said pawls in said pivotable position for transmitting rotation to said gear.

3. The ratcheting scewdriver as claimed in claim 1, wherein said circular wall and said recesses are arranged to have said portions of said pawls pivot through and outside the circumference of said circular wall when moving into said recesses.

4. The ratcheting screwdriver as claimed in claim 3, wherein said ring and said portions of said pawls have mutually contacting surfaces in sliding contact upon rotation of said ring for pivoting said pawls out of tooth engagement with said gear.

5. The ratcheting screwdriver as claimed in claim 1, wherein portions of said recesses are spaced apart between said recesses and on said ring a distance which is the same as the spacing of said pawls as measured along said circular wall, whereby said portions of said recesses can alternately receive said portions of said pawls and simultaneously are positionable for simultaneously receiving said portions of both said pawls.

6. The ratcheting screwdriver as claimed in claim 5, wherein said handle and said ring have mutually engageable portions for releasably securing said ring in the positions of having said recesses respectively alternately receive said portions of said pawls and in the position free of receiving said pawls.

7. The ratcheting screwdriver as claimed in claim 6, wherein said ring is rotatable on said handle in both clockwise and counter-clockwise directions, and said pawls are arranged to respectively drivingly engage said gear teeth in the same clockwise and counter-clockwise directions corresponding to the direction of rotation of said ring.

8. The ratcheting screwdriver as claimed in claim 6, wherein said handle and said ring have mutually engageable portions for limiting the rotation of said ring on said handle in both directions of rotation, and with the latter said portions being located relative to said releasably securing portions of said handle and said ring, to stop rotation of said ring in the positions where said recesses receive said portions of said pawls.

9. The ratcheting screwdriver as claimed in claim 1, wherein said ring is rotatable on said handle in both clockwise and counter-clockwise directions and said pawls are arranged to respectively drivingly engage said gear teeth in the same clockwise and counter-clockwise directions corresponding to the direction of rotation of said ring.

10. In a ratcheting screwdriver of the type having a handle, a gear rotatable on said handle, two cavities in said handle and facing said gear, two pawls disposed in said cavities on said handle and being movable into and out of rotational drive contact with said gear, springs operative on said pawls for urging said pawls into contact with said gear, a control operative on said pawls for moving said pawls out of contact with said gear, a stop operative on said handle and said control for limiting movement of said control on said handle, and positioners on said handle and said control for releasably securing the moved positions of said control on said handle, the improvement comprising said cavities and said pawls being arcuate in shape and in arcuate contact and mutually slidable along their arcuate shapes for pivotal movement of said pawls into and out of engagement with said gear in the arcuate sliding of said pawls in said cavities, said pawls being arranged and disposed to present a line of force from said arcuate shape of said pawls and toward said gear and with said line of force being tangential to said gear, and said control comprises a ring rotatably mounted on said handle and having an internal circumferentially-shaped wall with portions thereof in contact with said pawls adjacent said arcuate contact, for positioning said pawls out of contact with said gear, and said ring having two recesses on said circumferentially-shaped wall and adjacent said pawls for receiving portions of said pawls in the pivoted positions of said pawls into contact with said gear.

11. The ratcheting screwdriver as claimed in claim 10, wherein said ring is rotatable on said handle in both clockwise and counter-clockwise directions, and said pawls are arranged to respectively drivingly engage said gear teeth in the same clockwise and counter-clockwise directions corresponding to the direction of rotation of said ring.

12. In a ratcheting screwdriver of the type having a handle, a circular gear rotatable on said handle two pawls having teeth and being disposed on said handle and being spaced apart on a circle surrounding said gear and being movable into and out of rotational drive contact with said gear, springs operative on said pawls for urging said pawls into contact with said gear, a ring rotatable on said handle and having surfaces operative on surfaces of said pawls for moving said pawls out of contact with said gear, and positioners on said handle and said ring for releasably securing said ring in the rotated positions of said ring on said handle, the improvement comprising both said pawls being fully disposed on only one-half of said circle for respective engagement of said gear in the direction along a tangent to the circular shape of said gear and through said pawl and toward said teeth of said pawl and to said gear, and both said pawls having an extension adjacent said circle, and said ring has an internal circumferentially-shaped wall with portions thereof on said circle and in respective contact with said extensions of said pawls for positioning said pawls out of contact with said gear, said ring has two recesses on circumferentially-shaped wall and adjacent said wall portions for receiving a respective one of said extensions of said pawls in the pivoted positions of said pawls in contact with said gear, and said recesses being located on said one-half of said circle and spaced apart a distance along said circle less than the spacing between said pawls on said circle, for alternating reception of said extensions in the positioning of said pawls into contact with said gear.

13. The ratcheting screwdriver as claimed in claim 12, wherein said ring is rotatable on said handle in both clockwise and counter-clockwise directions, and said pawls are arranged to respectively drivingly engage said gear teeth in the same clockwise and counter-clockwise directions corresponding to the direction of rotation of said ring.

14. The ratcheting screwdriver as claimed in claim 12, wherein said springs are of flexible silicone material and are disposed in contact with said pawls and said handle and arranged to yieldingly urge said pawls into contact with said gear.

15. The ratcheting screwdriver as claimed in claim 12, wherein said springs are torsion springs centered on said pawls and arranged to yieldingly urge said pawls into contact with said gear.

16. A ratcheting screwdriver comprising a handle having a circular cavity, a gear rotatably supported on said handle and disposed in said cavity and having teeth and with said gear being arranged to receive a screwdriver bit, two pawls with teeth and being respectively pivotally supported on said handle and fully disposed on only one-half of the circle defined by said circular cavity for pivoting toward and away from said gear and extending into tooth-driving engagement with said gear teeth in one direction of handle rotation and said pawls being in ratcheting relationship with said gear in a direction of handle rotation which is opposite to said one direction, each of said pawls has a portion projecting through said circle when said pawls are pivoted into said tooth-driving engagement, a resilient member operative on said pawls for urging said pawls into said tooth-driving engagement with said gear teeth in the rotation drive from said handle to said gear, a ring rotatably supported on said handle and having a circular wall adjacent said portions of said pawls and being engageable with said portions of said pawls for pivoting said pawls out of said tooth-driving engagement with said gear, and said ring circular wall having two recesses therein adjacent said two pawls and being spaced apart for alternately receiving said portions of said pawls in the pivotal action of said pawls into said tooth-driving engagement with said gear.

17. The ratcheting screwdriver as claimed in claim 16, wherein portions of said recesses are spaced apart between said recesses and on said ring a distance which is the same as the spacing of said pawls as measured along said circular wall, whereby said portions of said recesses can alternately receive said portions of said pawls and simultaneously are positionable for simultaneously receiving said portions of both said pawls.

18. The ratcheting screwdriver as claimed in claim 16, wherein said handle and said ring have mutually engageble portions for limiting the rotation of said ring on said handle in both directions of rotation, and with the latter said portions being located to stop rotation of said ring in the positions where said recesses receive said portions of said pawls.

19. The ratcheting screwdriver as claimed in claim 16, wherein said resilient member is of flexible silicone material and is disposed in contact with said pawls and said handle and arranged yieldingly urge said pawls into contact with said gear.

20. The ratcheting screwdriver as claimed in claim 16, wherein said resilient member is torsion spring centered on each of said pawls and arranged to yieldingly urge said pawls into contact with said gear.

21. A ratcheting screwdriver comprising a handle, a gear rotatable on said handle, said handle having two pairs of two arcuate surfaces forming two pocket, two pawls having teeth and being pivotally disposed in respective said pockets and with a fixed pivot axis on said arcuate surfaces of said handle and being movable into and out of rotational drive contact with said gear, springs operative on said pawls for pivotally urging said pawls into contact with said gear, an actuator movable on said handle and having two recesses for respectively receiving said pawls for alternate movement of said pawls into contact with said gear, both said pawls being fully disposed on only one-half of said circle and with said teeth thereon being located for respective engagement of said gear to one side of a line through the axis of said gear and said pivot axis, and said actuator has two surfaces in respective contact with said pawls for positioning said pawls out of contact with said gear.

22. The ratcheting screwdriver as claimed in claim 21, wherein said actuator is a/ring rotatable on said handle in both clockwise and counter-clockwise directions, and said pawls are arranged to respectively drivingly engage said gear teeth in the same clockwise and counter-clockwise directions corresponding to the direction of rotation of said actuator.

23. The ratcheking screwdriver as claimed in claim 22, wherein said pawls have extensions disposed radially away from said gear relative to said pivot axis, said two recesses being on a circumferentially-shaped wall of said actuator and adjacent said extensions of said pawls in the pivoted positions of said pawls in contact with said gear, and said recesses being located only on said one-half of said circle and being spaced apart a distance along said circle less than all spacing between said pawls on said circle, for alternating reception of said extensions in the positioning of said pawls into contact with said gear.

24. The ratcheting screwdriver as claimed in claim 23, wherein said recesses are defined by surfaces on said ring, and with said surfaces of each of said recesses respectively being located to respectively abut said pawl extension for stopping rotation of said ring when said pawl is tooth-engaged with said gear.

25. The ratcheting screwdriver as claimed in claim 21, wherein each of said pairs of said arcuate surfaces have their said arcuate surfaces positioned diametrically opposed to each other to thereby present a portion of a circle which forms each of said pockets, and said pawls being pivotally supported respectively in said pockets.

* * * * *

UNITED STATES PATENT AND TRADEMARK OFFICE

CERTIFICATE OF CORRECTION

PATENT NO. : 5,619,891

DATED : April 15, 1997

INVENTOR(S) : Clair L. Tiede

It is certified that error appears in the above-identified patent and that said Letters Patent is hereby corrected as shown below:

Column 5, line 30, change "views" to --viewed--.

Column 6, line 9, change "31" to --69--.

Column 7, line 59, after "handle" insert a --comma--.

Column 9, line 11, after "arranged" insert --to--.

Column 9, line 19, change "pocket" to --pockets--.

Column 10, line 2, cancel "a/ring".

Column 10, lines 21 and 24, change "ring" to --actuator--.

Signed and Sealed this

Twenty-second Day of July, 1997

Bruce Lehman

*Attest:*

BRUCE LEHMAN

*Attesting Officer*

*Commissioner of Patents and Trademarks*